US007368864B2

(12) United States Patent
Suzuki

(10) Patent No.: US 7,368,864 B2
(45) Date of Patent: May 6, 2008

(54) SPARK PLUG

(75) Inventor: Akira Suzuki, Kasugai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 533 days.

(21) Appl. No.: 11/014,830

(22) Filed: Dec. 20, 2004

(65) Prior Publication Data

US 2005/0134159 A1 Jun. 23, 2005

(30) Foreign Application Priority Data

Dec. 19, 2003 (JP) ..... P.2003-422771

(51) Int. Cl.
*H01T 13/20* (2006.01)

(52) U.S. Cl. ..... 313/141; 313/143; 123/169 EL

(58) Field of Classification Search ..... 313/141–143, 313/118; 123/169 EL
See application file for complete search history.

(56) References Cited

U.S. PATENT DOCUMENTS 5,502,352 A * 3/1996 Katoh et al. ..... 313/141
6,229,253 B1 5/2001 Iwata et al.
6,819,032 B2 11/2004 Matsubara
6,831,397 B2 * 12/2004 Kanao et al. ..... 313/141
6,956,319 B2 * 10/2005 Hanashi et al. ..... 313/123

FOREIGN PATENT DOCUMENTS

JP 2000-68032 3/2000
JP 2001-237045 8/2001
JP 2002-313524 10/2002

* cited by examiner

*Primary Examiner*—Kimberly D. Nguyen
*Assistant Examiner*—Donald L Raleigh
(74) *Attorney, Agent, or Firm*—Sughrue Mion, PLLC

(57) ABSTRACT

A spark plug including: an insulator having an axial hole; a center electrode disposed in a tip end side of the axial hole of the insulator; a metal shell surrounding the insulator, a first ground electrode having one end bonded to the metal shell; a noble metal tip joined to an inner side face of another end portion of the first ground electrode body disposed opposite a tip end face of the center electrode; and a second ground electrode having one end bonded to the metal shell, and another end face disposed opposite a side peripheral face of said insulator to form a second discharge gap, wherein following relationships are satisfied as defined herein: $0.12 \leqq S \leqq 1.15$, $0.3 \leqq t \leqq 1.5$, $A+0.7(F-A) \leqq 1.8M$, and $-03 \leqq L/H$.

6 Claims, 3 Drawing Sheets

SPARK PLUG

BACKGROUND OF THE INVENTION

1. Field of the Invention

The present invention relates to a spark plug used for providing ignition of an internal combustion engine.

2. Description of the Related Art

Various spark plugs used for providing ignition of an internal combustion engine, such as an automotive engine, have been proposed in which a columnar noble metal tip is disposed not only on the tip end of a center electrode, but also on the tip end of a ground electrode. When a center electrode and a ground electrode constituting a first discharge gap become worn as result of spark discharge, durability is reduced. Therefore, durability is maintained by forming a noble metal tip at a position of the ground electrode corresponding to the first discharge gap.

Recently, there has been an increasing demand for enhancing the performance of an engine, and thus there is a need to further improve the ignitability of a spark plug. In order to improve ignitability, a configuration where a columnar noble metal tip is thinned is effective for the following reason. A flame kernel produced in a first discharge gap is caused to grow by swirling or the like. During the growing process, the noble metal tip makes contact with the flame kernel to impede its growth (hereinafter, this is also referred to as a flame quenching effect). When the noble metal tip is thick, the flame kernel easily makes contact with the noble metal tip, and hence is readily affected by the flame quenching effect. Therefore, a structure is often used in which the noble metal tip is thinned to suppress influence of the flame quenching effect due to contact of a flame kernel with the noble metal tip, thereby expediting growth of the flame kernel.

Another configuration where the distance in the axial direction is increased, between a face of the noble metal tip opposing the center electrode and the inner side face of the ground electrode (specifically, the body of the ground electrode) on the side of the center electrode (hereinafter, this distance is also referred to as a protrusion amount), is also effective for the following reason. When the protrusion amount of the noble metal tip is small, a flame kernel easily makes contact with the ground electrode body at an early stage of the growing process of the flame kernel, and hence the flame quenching effect readily occurs. Therefore, a structure in which the protrusion amount is increased so as to expedite the growth of a flame kernel is often employed (see JP-A-2001-345162).

The present inventors have found that the discharge voltage fluctuates in the spark plug of JP-A-2001-345162. In the case where such fluctuation occurs, when the discharge voltage is high, a flame kernel is hardly formed in a first discharge gap. Hence, ignitability is impaired, thereby resulting in a possibility of misfiring. In the case where carbon or the like adheres to the surface of an insulator to produce a so-called "fouling" state, when the discharge voltage is high, there is a possibility that a spark discharge is not produced between a center electrode and a ground electrode, but rather occurs between the center electrode and a metal shell while creeping along the surface of the insulator.

SUMMARY OF THE INVENTION

It is therefore an object of the present invention to provide a spark plug in which the ignitability is improved by thinning a noble metal tip (precious metal tip) formed in a ground electrode and increasing the protrusion amount, and in which fluctuation of the discharge voltage can be suppressed so that ignitability is maintained.

As a result of extensive study by the inventors, the above object of the present invention has been achieved by providing a spark plug which comprises: an insulator having an axial hole in an axial direction of the spark plug; a center electrode disposed in a tip end side of the axial hole of the insulator; a metal shell surrounding the insulator; a first ground electrode having: a first ground electrode body having one end that is bonded to the metal shell; and a noble metal tip joined to an inner side face of another end portion of the first ground electrode body on a side of the center electrode, and which opposes a tip end face of the center electrode across a first discharge gap; and a second ground electrode having one end that is bonded to the metal shell, and another end face which opposes at least a side peripheral face of the insulator to form a second discharge gap between a side peripheral face of the center electrode and the another end face of the second around electrode, and an area S (unit: $mm^2$) of an opposing face of the noble metal tip which opposes the tip end face of the center electrode, a distance t (unit: mm) in the axial direction between the opposing face of the noble metal tip and the inner side face of the first ground electrode body on the side of the center electrode, a size M (unit: mm) of the first discharge gap, a minimum distance F (unit: mm) in a radial direction between the side peripheral face of the center electrode and the another end face of the second ground electrode, a minimum distance A (unit: mm) in a radial direction between the another end face of the second ground electrode and the side peripheral face of the insulator, a minimum distance H (unit: mm) in the axial direction between a tip end face of the insulator and a middle point of the first discharge gap, and a minimum distance L (unit; mm) in the axial direction between the tip end face of the insulator and a tip end side edge of the another end face of the second ground electrode satisfy following relationships when the tip end side edge of the another end face of the second ground electrode protrudes a positive amount from the tip end face of the insulator:

$$0.12 \leqq S \leqq 1.15,$$

$$0.3 \leqq t \leqq 1.5,$$

$$A+0.7(F-A) \leqq 1.8M, \text{ and}$$

$$-0.3 \leqq L/H.$$

The spark plug of the invention is configured so that the area S of the opposing face of the noble metal tip which is formed into a columnar shape is 0.12 $mm^2$ or more and 1.15 $mm^2$ or less. In this configuration where the noble metal tip is thinned, when a flame kernel produced in the first discharge gap grows as a result of swirling or the like, influence of the flame quenching effect due to contact of the flame kernel with the noble metal tip can be suppressed. Consequently, growth of the flame kernel can be expedited, or namely, ignitability can be improved. When the area of the opposing face of the noble metal tip is smaller than 0.12 $mm^2$, the noble metal tip itself is so thin that the durability of the spark plug is reduced. By contrast, when the area of the opposing face of the noble metal tip is larger than 1.15 $mm^2$, the noble metal tip is so thick that the effect of improving ignitability is hardly obtained. The noble metal tip is preferably columnar but is not particularly limited, and may also have a cylindrical columnar shape, or a prism-like shape such as a triangular prism-like shape or a quadratic prism-like shape.

In the spark plug of the invention, the distance t (unit: mm) in the axial direction between the opposing face of the noble metal tip and the inner side face of the first ground electrode body on the side of the center electrode is 0.3 mm or more and 1.5 mm or less. In this configuration where the noble metal tip protrudes by a large amount, when a flame kernel produced in the first discharge gap which is formed by the center electrode and the first ground electrode grows as a result of swirling or the like, the possibility of the flame kernel making contact with the first ground electrode body at an early stage is reduced. Such protrusion cooperates with the area of the opposing face of the noble metal tip to improve ignitability. When the distance t in the axial direction between the opposing face of the noble metal tip and the inner side face of the first ground electrode body on the side of the center electrode is smaller than 0.3 mm, the effect of preventing a flame kernel from making contact with the first ground electrode body is hardly obtained as described above. By contrast, when the distance t in the axial direction between the opposing face of the noble metal tip and the inner side face of the first ground electrode body on the side of the center electrode is larger than 1.5 mm, the heat capacity of the noble metal tip is increased, and the durability of the noble metal tip itself may be lowered. As used herein, "inner side face on the side of the center electrode" means a face of the first ground electrode body on the side opposing the center electrode.

In a spark plug in which a noble metal tip is thinned and protrudes by a large amount as described above, there is a possibility of large discharge voltage fluctuations such that ignitability cannot be maintained. Therefore, the spark plug of the invention includes a second ground electrode in which one end is bonded to the metal shell, and another end face opposes the side peripheral face of the center electrode and/or the side peripheral face of the insulator to form a second discharge gap between the side peripheral face of the center electrode and the another end face of the second ground electrode. When the spark plug comprises such a second ground electrode, the electric field strength in the vicinity of the first discharge gap can be concentrated, and fluctuation of the discharge voltage can be suppressed. Since the electric field strength in the vicinity of the first discharge gap is concentrated, moreover, the discharge voltage is lowered, and misfiring hardly occurs.

In the spark plug of the invention, when the size M (unit; mm) of the first discharge gap, the minimum F (unit: mm) distance in a radial direction between the side peripheral face of the center electrode and the another end face of the second ground electrode, the minimum distance A (unit: mm) in a radial direction between the another end face of the second ground electrode and the side peripheral face of the insulator, the minimum distance H (unit: mm) in the axial direction between a tip end face of the insulator and a middle point of the first discharge gap, and the minimum distance L (unit: mm) in the axial direction between the tip end face of the insulator and a tip end side edge of the another end face of the second ground electrode satisfy the following relationships when the tip end side edge of the another end face of the second ground electrode protrudes a positive amount from the tip end face of the insulator: $A+0.7(F-A) \leqq 1.8M$, and $-0.3 \leqq L/H$. When $A+0.7(F-A)$ is larger than 1.8M, the electric field strength in the vicinity of the first discharge gap is hardly concentrated, and the effect of suppressing fluctuation of the discharge voltage cannot be obtained. Also, when L/H is smaller than −0.3, the electric field strength in the vicinity of the first discharge gap cannot be concentrated, and fluctuation of the discharge voltage cannot be suppressed. In the invention, "tip end side edge of the another end face of the second ground electrode" means a peripheral edge of the another end face of the second ground electrode, the peripheral edge being most separated from the metal shell in the axial direction.

Preferably, A is 0.2 mm or more. When A is smaller than 0.2 mm, the distance between the insulator and the second ground electrode is so small that a bridge may occur between the insulator and the second ground electrode.

In the spark plug of the invention, preferably, $M \leqq A+0.7(F-A)$, and $L/H \leqq 0.7$. When $A+0.7(F-A)$ is smaller than M, a spark discharge easily occurs in the second discharge gap between the another end face of the second ground electrode and the side peripheral face of the center electrode, and a spark discharge hardly occurs in the first discharge gap, whereby ignitability may be impaired. By contrast when L/H is larger than 0.7, the second ground electrode is excessively close to the vicinity of the first discharge gap, and there is a possibility that the flame quenching effect due to the second ground electrode easily occurs. Namely, at an early stage of the growing process of a flame kernel, the flame kernel easily makes contact with the second ground electrode body, whereby ignitability may be impaired.

In the spark plug of the invention, preferably, the noble metal tip contains one of Ir and Pt as a primary component. According to this configuration, the durability of the noble metal tip is improved. In the case where the primary component is Ir, preferably, the noble metal tip is an alloy containing-at least one selected from the group consisting of Rh, Pt, Ni, W, Pd, Ru, and Os. In the case where the primary component is Pt, preferably, the noble metal tip is an alloy containing at least one selected from the group consisting of Rh, Ir, Ni, W. Pd, Ru, and Os. As used herein, "primary component" means a component of the alloy which is contained in the largest ratio (by wt %).

In the spark plug of the invention, preferably, M>0.6 mm. In such a spark plug in which the size M of the first discharge gap is larger than 0.6 mm, when a noble metal tip is thinned and protrudes by a large amount, the discharge voltage tends to largely fluctuate. When the invention is applied to a spark plug in which the size M of the first discharge gap is larger than 0.6 mm, therefore, fluctuation of the discharge voltage can be effectively suppressed.

In the spark plug of the invention, preferably, a plurality of second ground electrodes are disposed. When a plurality of second ground electrodes are disposed in this manner, the electric field strength in the vicinity of the first discharge gap can be further concentrated, and fluctuation of the discharge voltage can be suppressed. Preferably, three or less second ground electrodes are disposed at a maximum. When four or more second ground electrodes are disposed, the number of the second ground electrodes disposed in the vicinity of the first discharge gap is so large that the flame quenching effect due to the second ground electrodes easily occurs, whereby ignitability may be impaired.

DESCRIPTION OF REFERENCE NUMERALS AND SIGNS

Figure 1:
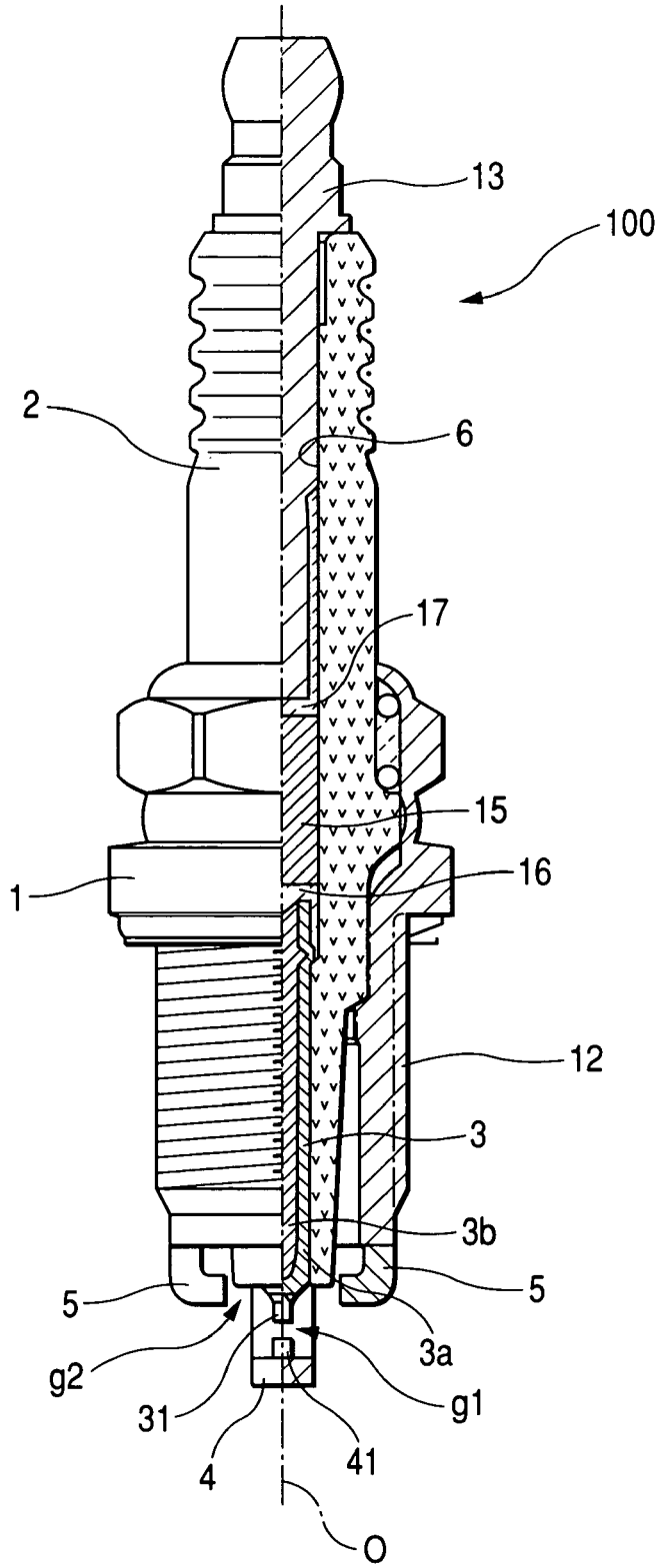
FIG. 1 is a front view partially in section showing a spark plug 100 of the invention.

Reference numerals are used to identify various elements in the drawings including the following:

| | |
|---|---|
| 1 | metal shell |
| 2 | insulator |
| 3 | center electrode |
| 4 | first ground electrode |
| 5 | second ground electrode |
| 6 | through hole |
| 31 | first noble metal tip |
| 41 | second noble metal tip |
| 100 | spark plug |

DETAILED DESCRIPTION OF THE INVENTION

Hereinafter, several embodiments of the invention will be described with reference to the accompanying drawings. However, the present invention should not be construed as being limited thereto.

Figure 2:
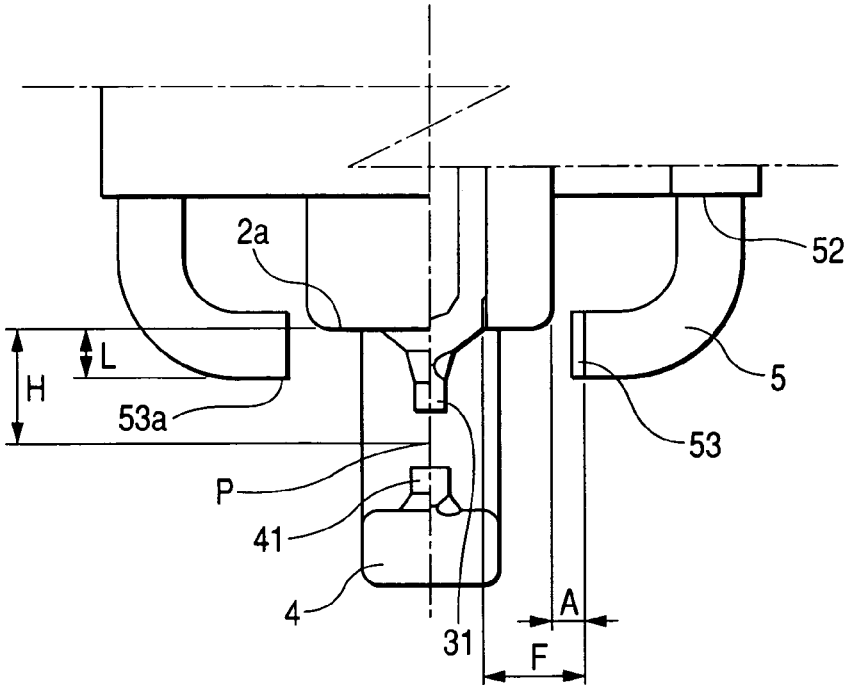
FIG. 2 is a front view partially in section showing main portions of FIG. 1.

A resistor-containing spark plug 100 of Embodiment 1 of the invention is shown in FIGS. 1 and 2, and comprises: a cylindrical metal shell 1; an insulator 2 which is fitted into the metal shell 1 so that a tip end portion protrudes therefrom; a center electrode 3 which is disposed inside the insulator 2 while projecting a first noble metal tip 31 joined to the tip end side; a first ground electrode 4 which is arranged so as to oppose the tip end face of the first noble metal tip 31 (the center electrode 3); and two second ground electrodes 5 which are disposed so as to oppose the center electrode 3 and the insulator 2. The second ground electrodes 5 are placed respectively in positions which are separated by 90° from the first ground electrode 4, and by 180° from each other. The second ground electrodes 5 are structured in the same manner. In the following description, therefore, only one of the second ground electrodes 5 will be described. The first ground electrode 4 is bent so that another end portion opposes the tip end face of the first noble metal tip 31 in a substantially parallel manner, and a second noble metal tip 41 is formed in a position opposing the first noble metal tip 31. A gap between the first noble metal tip 31 and the second noble metal tip 41 is formed as a first spark gap g1. A gap between the another end face of the second ground electrode 5 and the side peripheral face of the center electrode is formed as a second spark gap g2. In the second spark gap, spark discharge is generated in the form of creeping discharge along the surface of the insulator, and also in the form of aerial discharge through the air.

The metal shell 1 is made of carbon steel or the like. As shown in FIG. 1, a thread portion 12 (not shown) for mounting the spark plug 100 to an engine block is formed in the outer peripheral face of the metal shell. The insulator 2 is configured by a sintered body of ceramic such as alumina or aluminum nitride. A through hole 6 into which the center electrode 3 is to be fitted is formed inside the insulator along its axial direction. A terminal post 13 is fitted and fixed to one end side of the through hole 6, and the center electrode 3 is similarly fitted and fixed to the other end side. In the through hole 6, a resistor 15 is placed between the terminal post 13 and the center electrode 3. Conductive glass seal layers 16, 17 are disposed in the end portions of the resistor 15, and the ends are electrically connected to the center electrode 3 and the terminal post 13 via the conductive glass seal layers 16, 17, respectively.

An electrode base member 3*a* is formed in the surface of the center electrode, and a metal core 3*b* is inserted into the inner portion. The electrode base member 3*a* of the center electrode 3 is made of a Ni alloy such as INCONEL 600 (trademark of INCO Limited). By contrast, the metal core 3*b* is made of an alloy mainly containing Cu, Ag, and the like. The metal core 3*b* is higher in thermal conductivity than the electrode base member 3*a*. In the electrode base member 3*a* of the center electrode 3, the diameter of the tip end side is reduced, and the tip end face is flattened. A noble metal tip of a circular plate-like shape is placed on the tip end face, and a welded portion is formed along the outer edge of the joining face to fix the tip by laser welding, electron beam welding, resistance welding, or the like, thereby forming the first noble metal tip 31. The first noble metal tip 31 is made of a metal primarily containing Pt or Ir. Specifically, Pt alloys such as Pt-20 wt % Ir and Pt-20 wt % Rh, and Ir alloys such as Ir-5 wt % Pt, Ir-20 wt % Rh, Ir-5 wt % Pt-1 wt % Rh-1 wt % Ni, and Ir-10 wt % Rh-5 wt % Ni are useful.

The first ground electrode 4 is configured by a first ground electrode body 4*a* and the second noble metal tip 41. In the first ground electrode body 4*a*, one end 42 is fixed to and integrated with the tip end face of the metal shell 1 by welding or the like. By contrast, the second noble metal tip 41 is disposed on the another end portion 43 of the first ground electrode body 4*a*. The second noble metal tip 41 is formed by disposing a cylindrical columnar noble metal tip in a predetermined position of the first ground electrode body 4*a*, and fixing the tip thereto by laser welding, electron beam welding, resistance welding, or the like. The second noble metal tip 41 is made of a metal primarily containing Pt, Ir, or W. Specifically, Pt alloys such as Pt-20 wt % Ni, Pt-20 wt % Rh, and Pt-20 wt % Rh-5 wt % Ni, and Ir alloys such as Ir-5 wt % Pt, Ir-20 wt % Rh, and Ir-11 wt % Ru-8 wt % Rh-1 wt % Ni are useful. An opposing face 41*a* of the second noble metal tip 41 opposes the tip end face of the center electrode (specifically, the tip end face 31*a* of the first noble metal tip 31). The first ground electrode body 4*a* is made of a Ni alloy such as INCONEL 600. In this embodiment, the size M of the first discharge gap g1 between the tip end face 31*a* of the first noble metal tip 31 of the center electrode 3 and the opposing face 41*a* of the second noble metal tip 41 of the first ground electrode 4 is 1.1 mm.

In the second noble metal tip 41 in this embodiment, the opposing face 41*a* of the second noble metal tip 41 which opposes the noble metal tip 31 of the center electrode 3 has a diameter B of 0.7 mmϕ (an area S of 0.38 $mm^2$), and the second noble metal tip protrudes from the first ground electrode body 4*a* by a protrusion amount t of 0.8 mm. In this configuration, when the area S of the opposing face of the second noble metal tip 41 is 0.12 $mm^2$ or more and 1.15 $mm^2$ or less, influence of the flame quenching effect due to contact of a flame kernel with the noble metal tip can be suppressed. Accordingly, growth of the flame kernel can be expedited, and ignitability can be improved. Since the protrusion amount t by which the second noble metal tip 41 protrudes from the first ground electrode body 4*a* is 0.3 mm or more and 1.5 mm or less, the possibility of the flame kernel making contact with the first ground electrode body at an early stage is reduced. Accordingly, the growth of the flame kernel is expedited, whereby ignitability is improved.

In the second ground electrode 5, one end 52 is fixed to and integrated with the tip end face of the metal shell 1 by welding or the like. By contrast, another end portion 53 of the second ground electrode 5 opposes the side peripheral faces of the center electrode and the insulator 2. The second ground electrode 5 is made of a Ni alloy containing 90 wt % or more of Ni.

In this embodiment, the minimum distance F in a radial direction between the side peripheral face of the center electrode 3 and the another end face 53 of the second ground electrode 5 is 1.6 mm, and the minimum distance A in a radial direction between the another end face 53 of the second ground electrode 5 and the side peripheral face of the insulator 2 is 0.6 mm. Namely, $A+0.7(F-A)=1.3$, or $=1.18M$.

In this configuration where A+0.7(F−A)≦1.8M, the electric field strength in the vicinity of the first discharge gap g1 can be concentrated, and fluctuation of the discharge voltage can be suppressed, whereby ignitability can be maintained.

Figure 4:
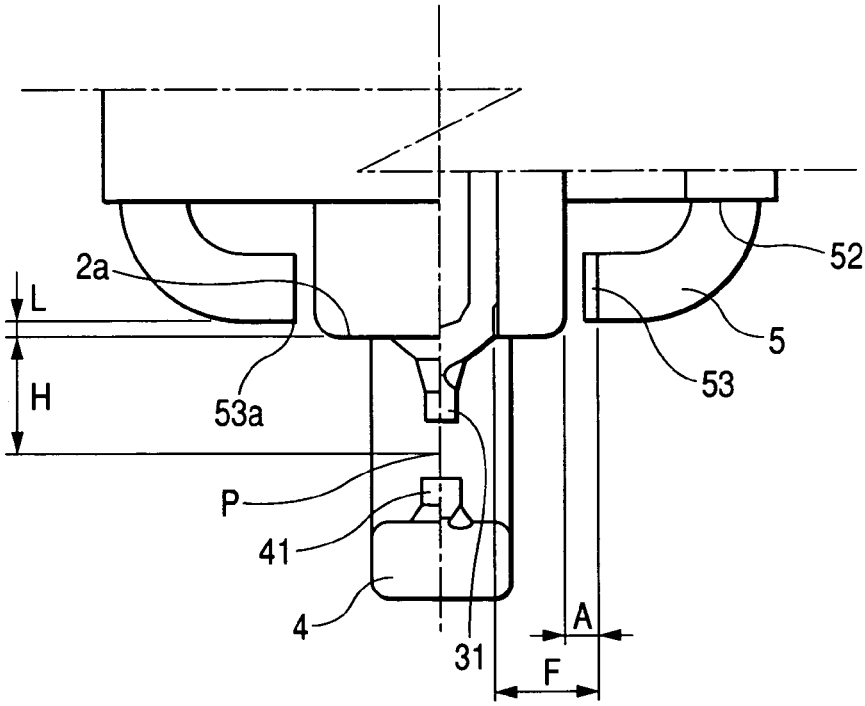
FIG. 4 is a front view partially in section showing another example of the spark plug 100 of Embodiment 1.

Moreover, the distance H in the axial direction between the tip end face 2*a* of the insulator 2 and a middle point P of the first discharge gap g1 is 2.05 mm, and the distance L in the axial direction between the tip end face 2*a* of the insulator 2 and a tip end side edge 53*a* of the another end face 53 of the second ground electrode 5 is 1 mm. Also in the configuration where L/H is −0.3 or more, fluctuation of the discharge voltage can be effectively suppressed. In the case where the tip end side edge protrudes a positive amount from the tip end face of the insulator, when the distance L has a negative value, the spark plug has a shape in which, as shown in FIG. 4, the tip end side edge 53*a* of the another end face 53 of the second ground electrode 5 is retracted from the tip end face 2*a* of the insulator 2.

The spark plug 100 is produced in the following manner. In the following, description is made with placing emphasis on a method of producing main portions of the spark plug 100, and description of known components will be omitted or simplified.

First, alumina is used as a main raw material, and a sintering process is conducted at a high temperature to form the alumina into a predetermined shape, thereby forming the insulator 2. A steel member is used, and a plastic forming process is carried out to form the steel member into a predetermined shape, thereby forming the metal shell 1. In this process, a thread portion 12 is formed in the outer peripheral face of the tip end portion of the metal shell 1. Then, the rod-like center electrode 3, the first ground electrode body 4*a*, and the second ground electrode 5 which are made of a heat-resistant Ni alloy are formed. The metal core 3*b* is inserted to form the center electrode 3. The first ground electrode body 4*a* and the second ground electrode 5 are welded to the tip end face of the metal shell 1 by resistance welding. Thereafter, the second ground electrode 5 is bent toward a direction perpendicular to the axial direction by a known technique. In the center electrode 3, the diameter of the tip end portion is gradually reduced, and the first noble metal tip 31 is fixed to the tip end face by resistance welding, laser welding, or the like.

Then, the center electrode 3 is inserted into the through hole 6 of the insulator 2 so that the tip end side protrudes from the insulator 2. Next, the conductive seal layer 16, the resistor 15, and the conductive seal layer 17 are sequentially inserted into the rear end side, the terminal post 13 is inserted into the rear end side of the insulator 2 so that the rear end side of the terminal post 13 protrudes from the rear end of the insulator 2, and the terminal post is fixed thereto by a known technique. Then, the insulator 2 to which the center electrode 3, the terminal post 13, and the like are fixed is attached by a known technique to the metal shell 1 to which the first ground electrode body 4*a* and the second ground electrode 5 are fixed, while adjusting the second spark gap g2 between the center electrode and the second ground electrode 5. The second noble metal tip 41 is fixed to the another end portion of the first ground electrode body 4*a* by resistance welding, laser welding, or the like. Thereafter, the first ground electrode 4 (the first ground electrode body 4*a*) is bent so that the opposing face 41*a* of the second noble metal tip 41 of the first ground electrode 4 opposes the tip end face 31*a* of the first noble metal tip 31 of the center electrode 3 via the first discharge gap g1, thereby completing the spark plug 100 for an internal combustion engine shown in FIG. 1.

EXAMPLES

In order to demonstrate the effects of the invention, the following various experiments were conducted. However, the present invention should not be construed as being limited thereto.

Example 1

In spark plugs in which the ignitability was improved by thinning a noble metal tip joined to a ground electrode and increasing the protrusion amount, first, fluctuation of the discharge voltage was measured. In the spark plugs of the example, sintered alumina ceramic was selected as the material of the insulator 2, INCONEL 600 as that of the electrode base member 3*a* of the center electrode 3, a copper core as the metal core 3*b*, INCONEL 600 as the material of the first ground electrode body 4*a*, a heat-resistant Ni alloy (an alloy of Ni-90 wt % Ni) as that of the second ground electrode 5, Ir-20 wt % Rh as that of the material of the first noble metal tip 31, and Pt-20 wt % Ni as that of the material of the second noble metal tip 41. The first noble metal tip 31 was formed as a cylindrical columnar shape having a diameter ϕ of 0.6 mm, and the second noble metal tip 41 was formed as a cylindrical columnar shape having a protrusion amount t of 0.8 mm and a diameter ϕ of 0.7 mm. The first ground electrode body 4*a* was set to have a width of 2.5 mm and a height of 1.4 mm. By contrast, in spark plugs of a comparative example, the protrusion amount t of the second noble metal tip 41 was 0.1 mm, and the materials and other sizes were identical with those of the example.

In the spark plugs of the example and the comparative example in which M was 0.4, 0.6, 0.8, 1.0, and 1.2 (unit: mm), the resulting voltage fluctuations were compared. The test data is shown in Table 1 below. As an evaluation test, one spark plug of each of the example and the comparative example was prepared, and the spark discharge was tested. Specifically, under an ambient of 0.6 MPa, spark discharge was produced 500 times in each spark plug. The standard deviation of the 500 discharge voltages in each test was obtained. The standard deviations of discharge voltages in the spark plugs of the example and the comparative examples having the same gap size were compared with one another. The ordinate of Table 1 shows standard deviation of the discharge voltage of the example divided by the standard deviation of discharge voltage of the comparative example for a given gap size M (abscissa).

TABLE 1

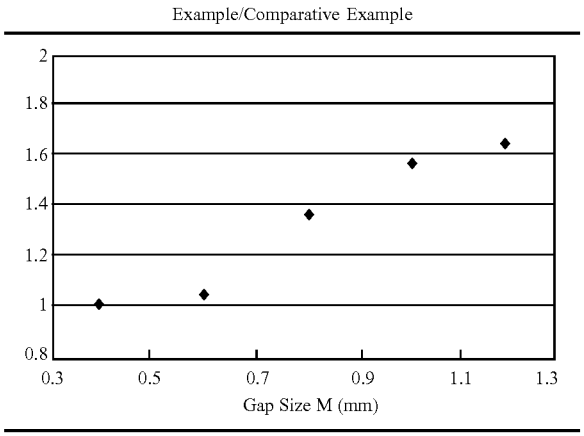

As seen from Table 1, when M is 0.6 mm or less, there is no substantial difference between the standard deviations of discharge voltages in the spark plugs of the example and the comparative example. By contrast, when M is larger than 0.6 mm, the standard deviation of discharge voltages in the spark plugs of the example is larger than that of the comparative example. Namely, it will be seen that, in a spark plug in which the ignitability is improved by thinning a noble metal tip and increasing the protrusion amount, when M is larger than 0.6 mm, the discharge voltage readily fluctuates.

Example 2

Next, various samples of the spark plug having the shape shown in FIGS. 1 and 2 were prepared in the following manner. First, in the same manner as Example 1, sintered alumina ceramic was selected as the material of the insulator 2, INCONEL 600 as that of the electrode base member 3*a* of the center electrode 3, a copper core as the metal core 3*b*, INCONEL 600 as the material of the first ground electrode body 4*a*, a heat-resistant Ni alloy (an alloy of Ni-90 wt % Ni) as that of the second ground electrode 5, Ir-20 wt % Rh as that of the first noble metal tip 31, and Pt-20 wt % Ni as that of the second noble metal tip 41. The first noble metal tip 31 was formed as a cylindrical columnar shape having a diameter ϕ of 0.6 mm, and the second noble metal tip 41 was formed as a cylindrical columnar shape having a protrusion amount t of 0.8 mm and a diameter ϕ of 0.7 mm. The first ground electrode body 4*a* was set to have a width of 2.5 mm and a height of 1.4 mm, and the second ground electrode 5 was set to have a width of 2.2 mm and a height of 1.2 mm. As a comparative example, spark plugs not having a second ground electrode 5 were prepared. The materials and sizes of the spark plugs of the comparative example were identical with those of the examples.

Figure 3:
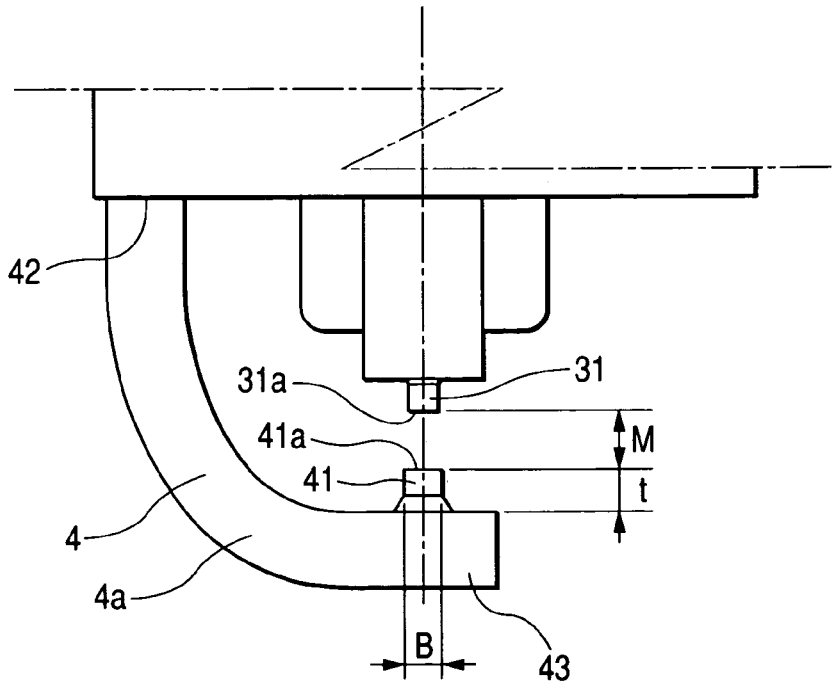
FIG. 3 is a side view showing main portions of FIG. 1.

In order to determine the relationship between M and the electric field strength in the case where F in FIGS. 2 and 3 was 1.5 mm and A was 0.5 mm, the electric field strengths when M was set to 0.4, 0.6, 0.8, 0.9, 1.1, 1.3, 1.5, 1.7 and 1.9 (unit: nm) were calculated by FEM analysis (finite

TABLE 2

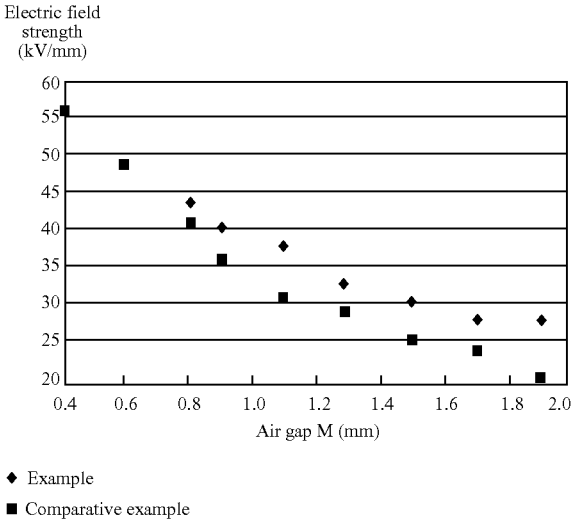

In order to determine the relationship between M and the electric field strength in the case where F in FIGS. 2 and 3 was 1.8 mm and A was 0.8 mm, the electric field strengths when M was set to 0.4, 0,6, 0.8, 0.9, 1.1, 1.3, 1.5, 1.7, and 1.9 (unit: mm) were calculated by FEM analysis (finite element analysis). The results are shown in Table 3 below.

TABLE 3

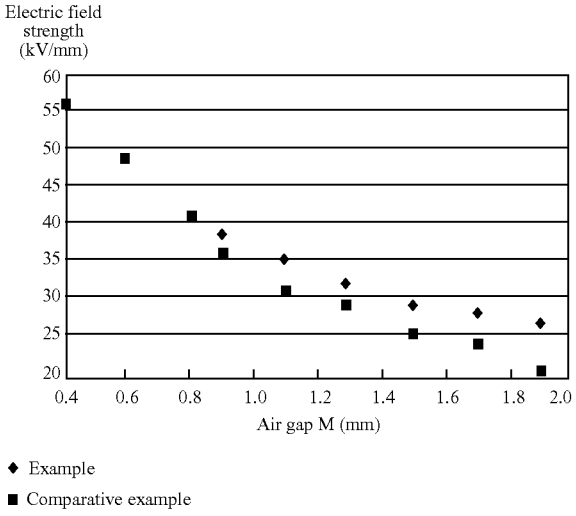

In order to determine the relationship between M and the electric field strength in the case where F in FIGS. 2 and 3 was 2.1 mm and A was 1.1 mm, the electric field strengths when M was set to 0.4, 0.6, 0.8, 0.9, 1.1, 1.3, 1.5, 1.7 and 1.9 (unit: mm) were calculated by FEM analysis (finite element analysis). The results are shown in Table 4 below.

TABLE 4

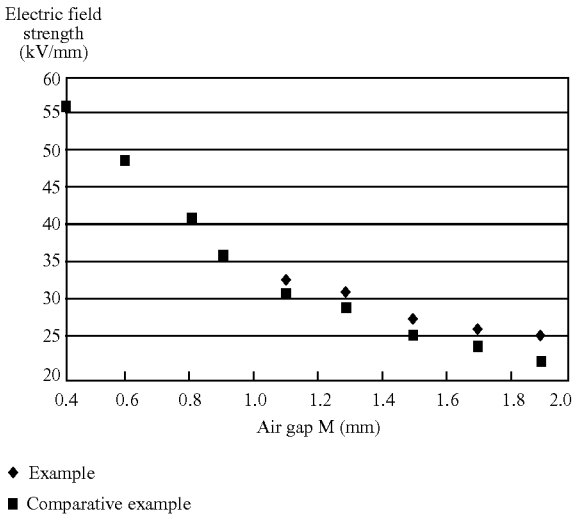

As seen from Table 2, when M was 0.6 mm or less, there was no difference in electric field strength between the example and the comparative example, but, when M was 0.8 mm or more, the electric field strength of the example was higher than that of the comparative example. Namely, it will be seen that the electric field strength is increased by the second ground electrode. As seen from Table 3, when M was 0.8 mm or less, there was no difference in electric field strength between the example and the comparative example, but, when M was 0.9 mm or more, the electric field strength of the example was higher than that of the comparative example. Namely, it will be seen that the electric field strength is increased by the second ground electrode. As shown in Table 4, when M was 0.9 mm or less, there was no difference in electric field strength between the example and the comparative example, but, when M was 1.1 mm or more, the electric field strength of the example was higher than that of the comparative example. Namely, it will be seen that the electric field strength is increased by the second ground electrode. From the above, when A+0.7(F−A)≦1.8M, the electric field strength is increased, and the discharge voltage is lowered.

Example 3

Next, in the spark plug 100 of the invention, while the size M of the first discharge gap g1, the minimum distance F in a radial direction between the side peripheral face of the center electrode 3 and the another end face 53 of the second ground electrode 5, and the minimum distance A in a radial direction between the another end face 53 of the second ground electrode 5 and the side peripheral face of the insulator 2 were fixed, the relationships between the electric field strength, and the distance H in the axial direction between the tip end face 2*a* of the insulator 2 and the middle point P of the first discharge gap g1, and the distance L in the axial direction between the tip end face 2*a* of the insulator 2 and the tip end side edge 53*a* of the another end face 53 of the second ground electrode 5 were determined. First, spark plugs which were identical with those of Example 1 were produced. The size M of the first discharge gap g1 was fixed to 1.1 mm, the minimum distance F in a radial direction between the side peripheral face of the center electrode 3 and the another end face 53 of the second ground electrode 5 was fixed to 1.8 mm, and the minimum distance A in a radial direction between the another end face 53 of the second ground electrode 5 and the side peripheral face of the insulator 2 was fixed to 0.8 mm.

In the spark plugs 100, in the same manner as Example 2, the electric field strengths were calculated by FEM analysis (finite element analysis). The results are shown in Table 5 below.

TABLE 5

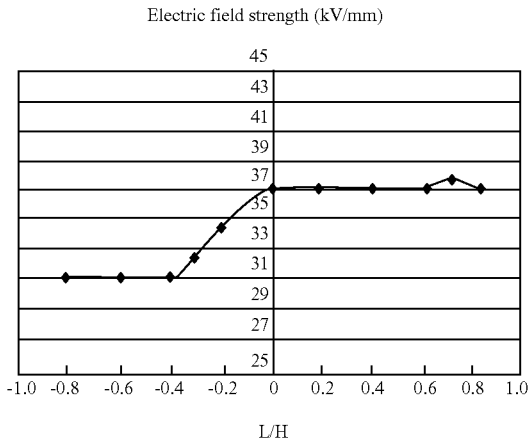

As seen from Table 5, when L/H is −1, the electric field strength is 31, when L/H is −0.8, the strength is 31, when L/H is −0.6, the strength is 30.8, when L/H is −0.4, the strength is 31, when L/H is −0.3, the strength is 32, when L/H is −0.2, the strength is 34, when L/H is 0, the strength is 37, when L/H is 0.2, the strength is 37, when L/H is 0.4, the strength is 37, when L/H is 0.6, the strength is 37, when L/H is 0.7, the strength is 37, and, when L/H is 0.8, the strength is 37.2. In this manner, when L/H is smaller than −0.3, the electric field strength is 32 or less, but, when L/H is −0.3 or more, the electric field strength is larger than 32. From the above, when L/H is −0.3 or more, the electric field strength is increased.

Example 4

Next, 100 spark plugs identical to those of Example 2 were prepared, and the spark discharge thereof was evaluated in the following test. Spark discharge was effected in the spark plugs at a pressurized atmosphere of 0.6 MPa. The number of occurrences of spark discharge in the second ground electrode was counted. The results are shown in Table 6 (F=1.5 mm, A=0.5 mm), Table 7 (F=1.8 mm, A=0.8 mm) and Table 8 (F=2.1 mm, A=1.1 mm) below.

TABLE 6

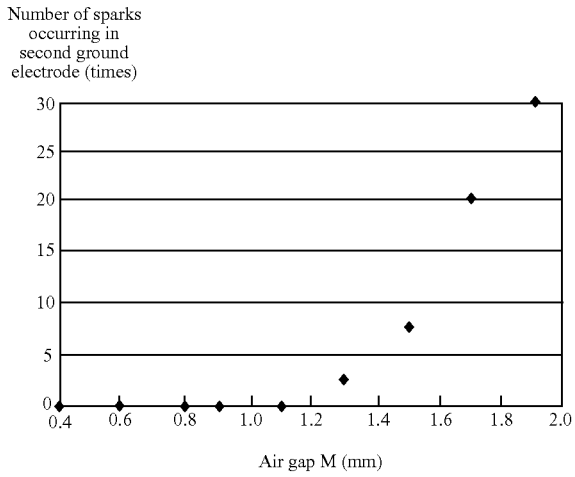

TABLE 7

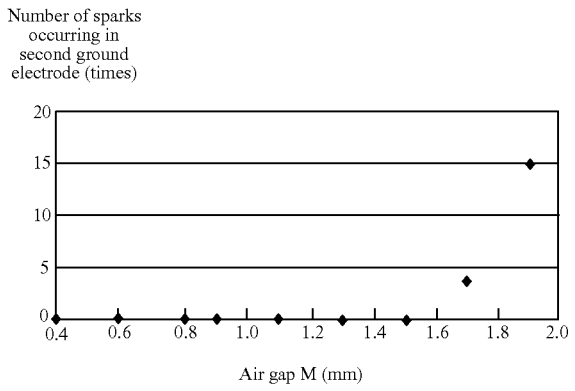

TABLE 8

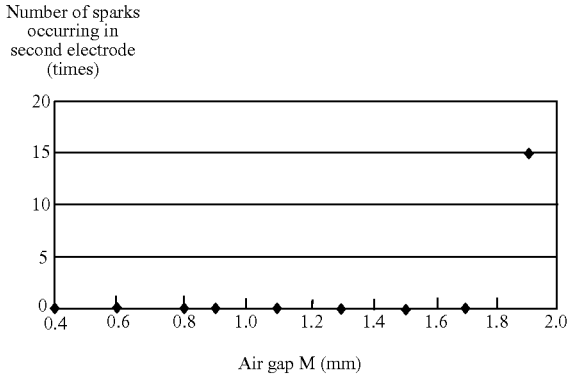

TABLE 9

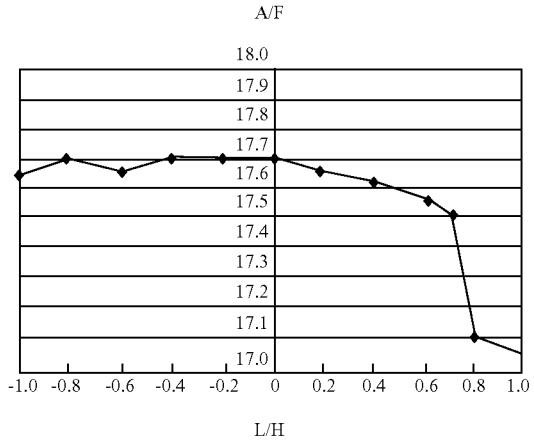

As seen from Table 6, when M was 1.1 mm or less, the number of sparks occurring in the second ground electrode was 0. However, when M was 1.3 mm, the number increased to 3, when M was 1.5 mm, the number increased to 8, when M was 1.7 mm, the number increased to 20, and, when M was 1.9 mm, the number increased to 30. As seen from Table 7, when M was 1.5 mm or less, the number of sparks occurring in the second ground electrode was 0. However, when M was 1.7 mm, the number increased to 4, and, when M was 1.9 mm, the number increased to 15. As seen from Table 8, when M was 1.7 mm or less, the number of sparks occurring in the second ground electrode was 0. However, when M was 1.9 mm, the number increased to 15. From the above, it will be seen that, when $M \leqq A+0.7(F-A)$, spark discharge readily occurs in the second discharge gap between the another end face of the second ground electrode and the side peripheral face of the center electrode.

Example 5

Next, while using spark plugs identical with those of Embodiment 3, the relationships between ignitability, and the distance H in the axial direction between the tip end face 2*a* of the insulator 2 and the middle point P of the first discharge gap g1, and the distance L in the axial direction between the tip end face 2*a* of the insulator 2 and the tip end side edge 53*a* of the another end face 53 of the second ground electrode 5 were determined.

Spark plugs produced in the same manner as those of Embodiment 3 were mounted on a four-cylinder engine having a displacement of 2,000 cc. Under engine idling conditions (engine revolutions: 700 rpm), ignitability was tested while shifting the A/F (air-file ratio) from the lean side. In this test, under the above engine conditions, the value of A/F when misfiring occurred ten times was determined as the ignition limit. The relationships between the value of A/F and L/H at this timing were checked. The results are shown in Table 9 below.

As seen from Table 9, when L/H is −1, A/F is 17.65, when L/H is −0,8, A/F is 17.7, when L/H is −0.6, A/F is 17.65, when L/H is −0.4, A/F is 17.7, when L/H is −0.2, A/F is 17.7, when L/H is 0, A/F is 17.7, when L/H is 0.2, A/F is 17.65, when L/H is 0.4, A/F is 17.62, when L/H is 0.6, A/F is 17.55, when L/H is 0.7, A/F is 17.5, when L/H is 0.8, A/F is 17.1, and, when L/H is 1, A/F is 17.06. As shown above, when L/H is 0.7 or less, the ignition limit has a high value or A/F is 17.5 or more, but, when L/H is larger than 0.7, A/F is smaller than 17.5. Also, when L/H is 0.7 or less, the ignitability can be maintained.

The invention is not restricted to the above-described specific embodiments, and may be realized in embodiments which are variously modified in accordance with the purpose and use within the scope of the invention.

In the spark plug 100 of the invention, for example, the metal core 3*b* is inserted into only the center electrode 3. The invention is not limited to this configuration. Another metal core may be inserted into one of the first ground electrode body 4*a* and the second ground electrode 5. The material of the metal core can be a single metal such as Cu or Ag, or an alloy.

The spark plug 100 of the invention comprises two second ground electrodes 5. The invention is not restricted to this configuration. The spark plug may comprise only a single second ground electrode. When a plurality of second ground electrodes are disposed, the electric field strength can be effectively concentrated. Therefore, the spark plug may comprise three or more second ground electrodes.

This application is based on Japanese Patent application JP 2003-422771, filed Dec. 19, 2003, the entire content of which is hereby incorporated by reference, the same as if set forth at length.

What is claimed is:

1. A spark plug comprising:

an insulator having an axial hole in an axial direction of said spark plug;

a center electrode disposed in a tip end side of said axial hole of said insulator;

a metal shell surrounding said insulator;

a first ground electrode including a first ground electrode body having one end bonded to said metal shell; and a noble metal tip joined to an inner side face of another end portion of said first ground electrode body on a side of said center electrode and disposed opposite a tip end face of said center electrode across a first discharge gap; and a second ground electrode having one end bonded to said metal shell, and another end face disposed opposite a side peripheral face of said insulator to form a second discharge gap between a side peripheral face of said center electrode and said another end face of said second ground electrode, wherein an area S (unit: $mm^2$) of an opposing face of said noble metal tip disposed opposite said tip end face of said center electrode, a distance t (unit: mm) in an axial direction between said opposing face of said noble metal tip and said inner side face of said first ground electrode body on a side of said center electrode, a size M (unit: mm) of said first discharge gap, a minimum distance F (unit: mm) in a radial direction between said side peripheral face of said center electrode and said another end face of said second ground electrode, a minimum distance A (unit: mm) in a radial direction between said another end face of said second ground electrode and said side peripheral face of said insulator, a minimum distance H (unit: mm) in an axial direction between a tip end face of said insulator and a middle point of said first discharge gap, and a minimum distance L (unit: mm) in an axial direction between said tip end face of said insulator and a tip end side edge of said another end face of said second ground electrode satisfy the following relationships when said tip end side edge of said another end face of said second ground electrode protrudes from said tip end face:

$$0.12 \leqq S \leqq 1.15,$$

$$0.3 \leqq t \leqq 1.5,$$

$$A+0.7(F-A) \leqq 1.8M, \text{ and}$$

$$-0.3 \leqq L/H.$$

2. The spark plug as claimed in claim 1, satisfying the following relationships:

$$M \leqq A+0.7(F-A), \text{ and}$$

$$L/H \leqq 0.7.$$

3. The spark plug as claimed in claim 1, wherein said noble metal tip contains one of Ir and Pt as a primary component.

4. The spark plug as claimed in claim 1, wherein said noble metal tip contains: an alloy containing Ir and at least one selected from the group consisting of Rh, Pt, Ni, W, Pd, Ru and Os; or an alloy containing Pt and at least one selected from the group consisting of Rh, Ir, Ni, W, Pd, Ru and Os.

5. The spark plug as claimed in claims 1, satisfying the following relationship:

$$M > 0.6 \text{ mm}.$$

6. The spark plug as claimed in claim 1, wherein said spark plug comprises a plurality of said second ground electrodes.

* * * * *